United States Patent [19]

Newbold

[11] Patent Number: 4,465,251

[45] Date of Patent: Aug. 14, 1984

[54] TOY PARACHUTE AND RELEASE MECHANISM

[76] Inventor: Larry E. Newbold, 10 Shadow La., Cape May Court House, N.J. 08210

[21] Appl. No.: 399,258

[22] Filed: Jul. 19, 1982

[51] Int. Cl.[3] ..... A63H 27/08

[52] U.S. Cl. ..... 244/155 R

[58] Field of Search ..... 244/155 A, 155 R, 94; 294/66 R, 66 A; 43/17.2

[56] References Cited

U.S. PATENT DOCUMENTS

| | | | |
|---|---|---|---|
| 985,301 | 2/1911 | Terry | 244/155 R |
| 2,105,128 | 1/1938 | Plane | 244/155 R |
| 3,023,987 | 3/1962 | Johnson, Jr. | 244/155 R |
| 4,286,402 | 9/1981 | Kuhn et al. | 43/17.2 |

FOREIGN PATENT DOCUMENTS

| | | | |
|---|---|---|---|
| 590621 | 7/1947 | United Kingdom | 244/155 R |

*Primary Examiner*—Trygve M. Blix
*Assistant Examiner*—Rodney Corl
*Attorney, Agent, or Firm*—John S. Roberts, Jr.

[57] ABSTRACT

The present invention teaches a new launcher or release mechanism for a toy parachute. The parachute is hooked to a release mechanism which, in turn, is hooked to the string or monofilament attached to a kite. The release mechanism is designed to carry variable amounts of weight as required to meet changing wind conditions. The launcher also contains a movable member attached to a biasing means which prevents premature release of the parachute.

6 Claims, 6 Drawing Figures

TOY PARACHUTE AND RELEASE MECHANISM

BACKGROUND OF THE INVENTION

This invention is a toy which launches parachutes from a kite. A toy parachute is attached to the launcher and wind blowing into the open parachute pulls the launcher and parachute up the kite line until the launcher comes into contact with a cork trip placed on the line just below the kite. The parachute is released from the launcher upon contact with the cork. The launcher, which contains a place to add additional weight, then slides back down the line and is ready for a new parachute. There are several other parachute launchers on the market today, but all have a common problem with releasing the parachute permaturely due to wind surging into the open canopy of the chute. This launcher's unique trip mechanism and the variable weight make it an improvement over the existing launchers.

An example of other launchers known to the art is Morris U.S. Pat. No. 3,482,807 which is similar to the present invention but is deficient in two major areas. First, the movable member which forms a part of the release mechanism and holds the parachute in place contains no corresponding biasing means. In practice, wind surging into the open canopy of the parachute pulls open the movable member, thus releasing the parachute prior to contact with the cork trip. Second, the release mechanism does not contain any place to add weight. In practice, the release mechanism will slide up the kite string but because it is so light will not slide back down. The present application has corrected these deficiencies. An elastic biasing means holds the movable member in place and will only release the parachute upon contact with the cork trip. In addition, there is a capped hollow into which can be placed weights, such as lead shot or BB's, which add sufficient weight to the release mechanism so that it will slide back down the line holding the kite.

Four other patents show similar devices but are also deficient for the reasons given for the Morris patent: Haight U.S. Pat. No. 1,484,775; Peterson U.S. Pat. No. 1,844,594; Droullard U.S. Pat. No. 3,034,751; and Sulger U.S. Pat. No. 3,062,488.

SPECIFIC DESCRIPTION OF THE INVENTION

Figure 1:
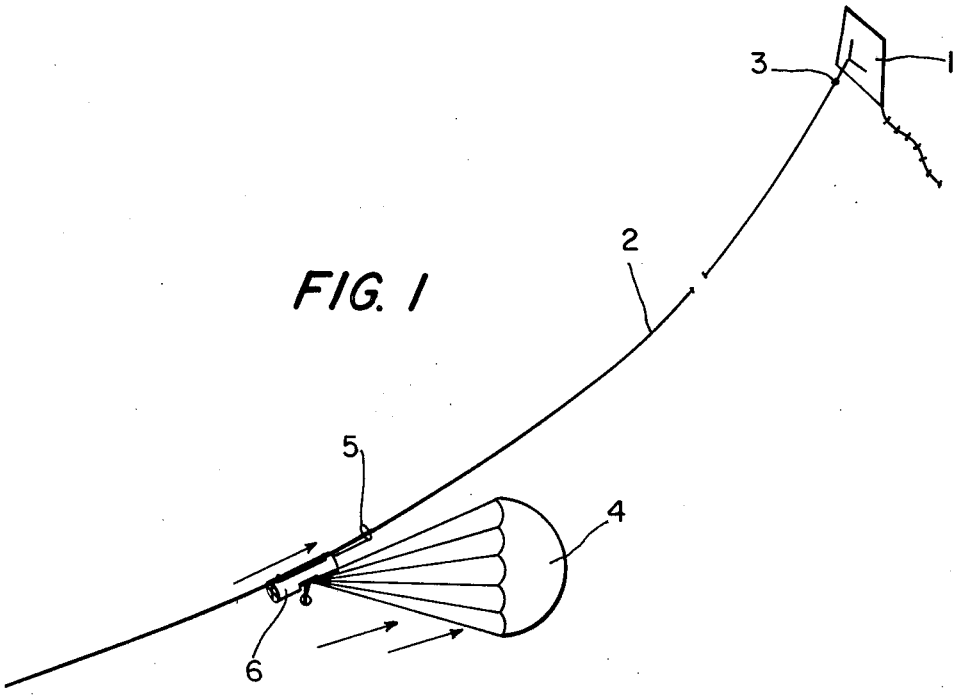
FIG. 1 is an overall view of the invention.
Figure 2:
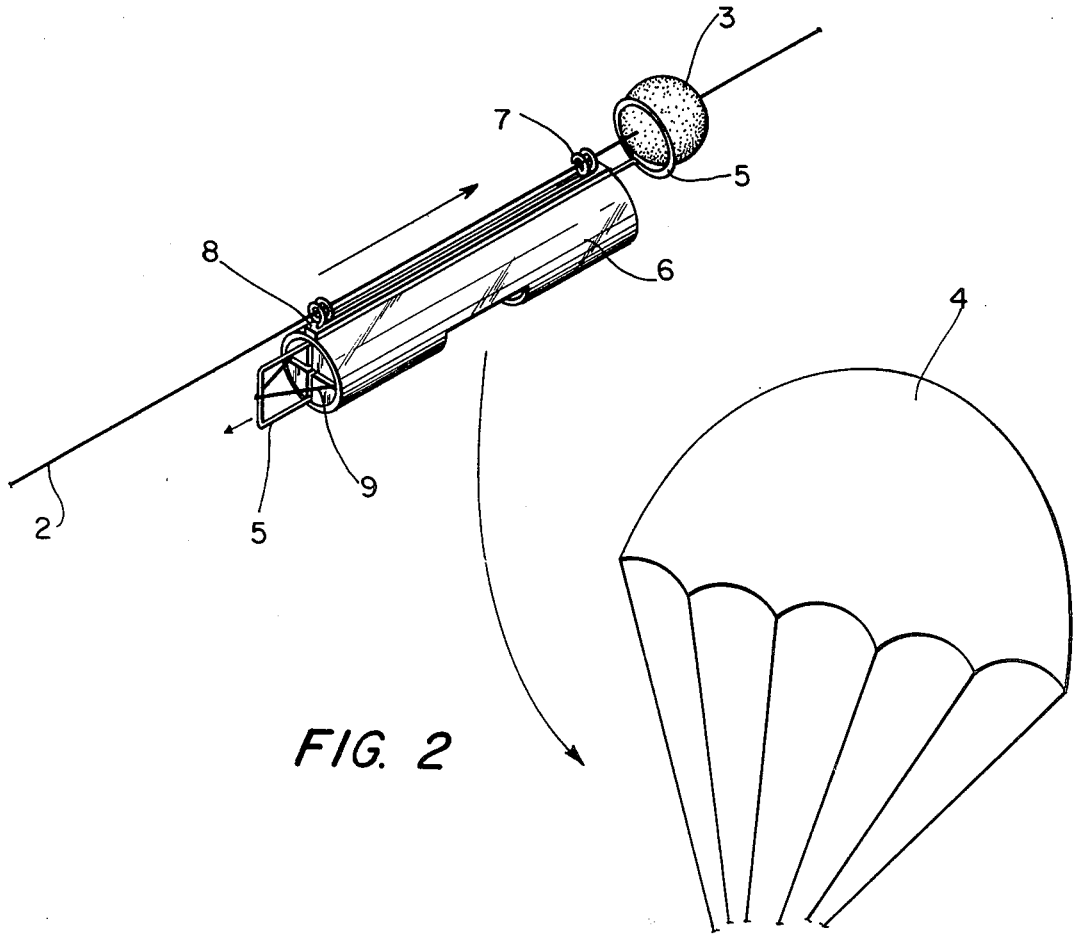
FIG. 2 shows the overall action of the release mechanism.
Figure 3:
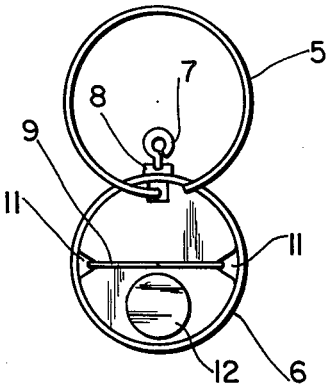
FIG. 3 is the front view of the release mechanism.
Figure 4:
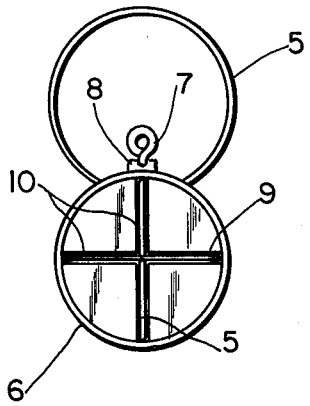
FIG. 4 is the rear view of the release mechanism.
Figure 5:
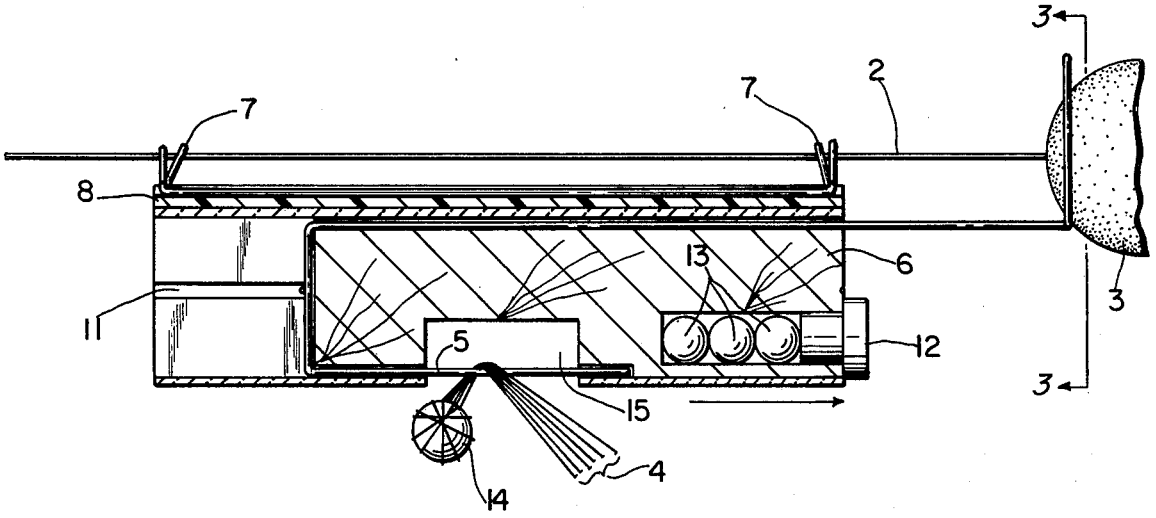
FIG. 5 is a side view of the release mechanism showing the closed position.
Figure 6:
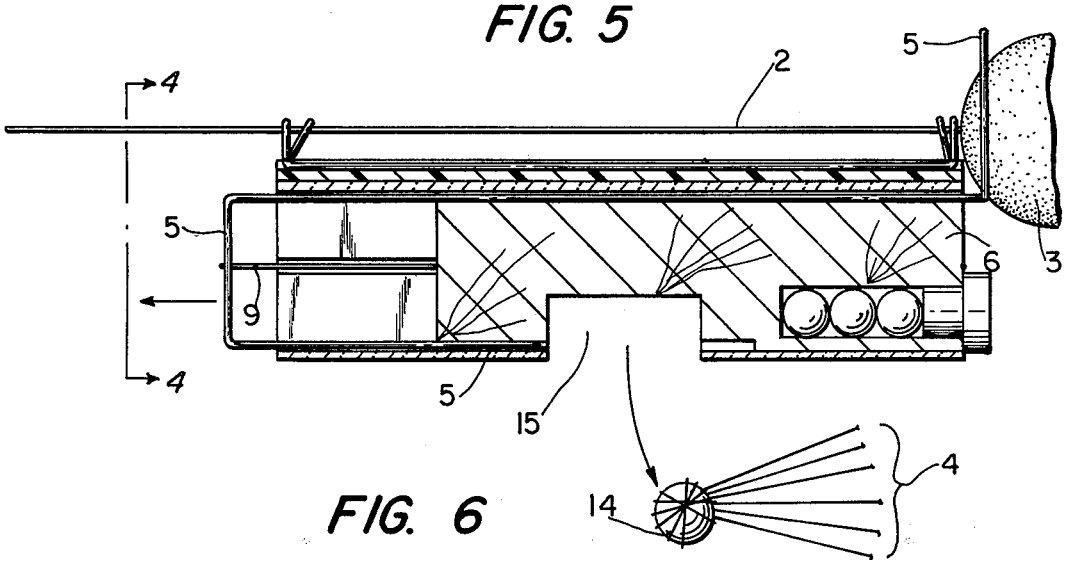
FIG. 6 is a side view of the release mechanism showing the open position.

A kite 1 on a line 2 has a cork or stopper 3 attached near the top of the line 2. The action of the surrounding wind draws a parachute 4, attached to a cylindrical release mechanism or launcher 6, up the line. Attached to the release mechanism is a movable member 5 through which the line passes. As the release mechanism 6 connected to the line by wire loop 7 travels up the line, it hits the cork 3. The movable member 5 hits the cork 3 and the parachute is released. Once the release mechanism 6 begins to return down the line, elastic biasing means 9 forces the movable member 5 back into place. The line attached to the kite passes through wire loop 7 which is attached to the release mechanism 6 by a grooved gutter 8. Elastic biasing means 9, bisecting the release mechanism 6, runs the length of the cylinder through grooves 11. The front end contains a capped compartment 12 to hold lead shot or weights. The rear end also contains a wire loop 7 attached to a grooved gutter 8 through which passes a line connected to a kite. The cylindrical release mechanism has horizontal and vertical grooves 10 cut into it through which the movable member 5 runs vertically and the elastic biasing means 9 runs horizontally. A space 15 has been cut out of the cylinder in order to accommodate parachute strings. A cap 12 holds lead shot or weights 13 in a compartment. In short, the movable member 5 hits the cork and presses against the elastic biasing means 9 and opens the space 15, allowing the parachute 4 to drop away from the release mechanism 6.

The description given above is not intended to restrict this invention from alternative forms. The release mechanism operates with or without a sleeve. The sleeve may be made of a light weight material made of either plastic tubing or aluminum tubing. If a sleeve is used, the interior part of the cylinder can be made of either balsa wood or styrofoam rods. The sleeve, however, is not a necessary component, although it is preferred.

In light winds the launcher can be used without a cap for the shot department in order to reduce the weight of the launcher. During more windy conditions, one, two, three or four lead shots or weight may be added as needed. The cap may be threaded so that it will sit more firmly in place. The elastic biasing means which prevents the wire trigger rod from prematurely releasing the parachute may be made of any resilient material, such as a rubber band, an elastic, or a spring. The monofilament, which is attached to the kite, may be string, wire, or fishing line. Spraying the monofilament with silica spray significantly eases ascent and descent of the launcher. A sponge-type material attached at the base of the kite line acts as a recoil when the launcher descends after releasing the parachute. Attachment of a recoil in this manner prevents injury to the person holding the kite string and reduces destruction of the launcher release mechanism as it hurdles back toward the ground. The parachute may be made of plastic or paper napkins and may be weighted by plastic men or paper clips or stones or similar material. A swivel, connecting the parachute line to the weight, prevents the parachute lines from tangling as the wind pushes the chute up the monofilament line.

I claim:

1. A release device for a parachute comprising a body having means thereon adapted on said body to support the same on an elongated monofilament, a recess formed in said body, an exterior groove on said body having a movable member slidable in said groove and an exterior sleeve providing a bearing surface for said movable member and an exterior boundary for said groove, a movable member disposed on said body and including a portion adapted to move from a normally closed position with respect to said recess wherein a parachute is adapted to be held captive to a position wherein the same is opened to release the same, abutment means adapted to be positioned on said monofilament forwardly of said body and adapted to be engaged by said movable member for moving the said portion to an open position to release said parachute, and elastic biasing means connected to said body and movable member maintaining the latter in its closed position wherein the body includes an opening adapted to receive variable weights.

2. The release device of claim 1 wherein said biasing means includes a resilient member supported in said body and engaging another portion of said movable member for urging the movable member to its closed position.

3. The release device of claims 1 or 2 wherein the body contains transversely disposed grooves adapted so that a first groove houses said movable member and a second groove, perpendicularly situated to the first groove, houses said, biasing means, the position of which is such that said biasing means crosses over said movable member.

4. The release device of claim 3 wherein said biasing means is chosen from the group consisting of rubber bands, elastics, and springs.

5. The release device of claim 1 wherein a sleeve covers said body, said sleeve having means thereon adapted to support the same on said monofilament, and containing an opening formed in said sleeve positioned to allow access to said recess formed in said body.

6. The release device of claim 1 wherein the body is constructed of balsa wood, aluminum, or any light weight material.

* * * * *